United States Patent [19]

Townsend

[11] 4,332,386

[45] Jun. 1, 1982

[54] EUCHRE SCORE BOARD

[76] Inventor: Richard J. Townsend, 49357 Au Lac Dr. East, Bay 8, Mt. Clemens, Mich. 48045

[21] Appl. No.: 183,104

[22] Filed: Sep. 2, 1980

[51] Int. Cl.[3] ..... A63F 1/18

[52] U.S. Cl. ..... 273/148 A; 235/90

[58] Field of Search ..... 273/148 R, 148 A; 235/90; 116/222, 325

[56] References Cited

U.S. PATENT DOCUMENTS

| | | | |
|---|---|---|---|
| 788,779 | 5/1905 | Lang | 235/90 |
| 1,656,993 | 1/1928 | Searle | 273/148 R |
| 2,477,825 | 8/1949 | Richardson | 235/90 |
| 2,544,900 | 3/1951 | Saqui | 235/90 X |
| 2,628,776 | 2/1953 | Newman | 273/148 A UX |
| 3,695,512 | 10/1972 | Trudel | 235/90 |
| 4,006,905 | 2/1977 | Marbury | 273/150 X |
| 4,195,767 | 4/1980 | Harden | 235/90 |

*Primary Examiner*—Anton O. Oechsle

*Attorney, Agent, or Firm*—Remy J. VanOphem

[57] ABSTRACT

A euchre score board comprising a body portion defining a playing surface divided into two substantially mirror image result tabulation areas. The tabulation areas each comprise a column of N peg receiving holes for tabulating the number of points aquired by a single playing entity in a game, where N equals the number of points required to win the game. Each tabulation area also includes a column of ½N-1 peg receiving holes for tabulating the number of "euchres" scored by the respective playing entities in the course of the game. A centrally located column of score indicating numerals is disposed in registry with all of the columns.

12 Claims, 4 Drawing Figures

EUCHRE SCORE BOARD

BACKGROUND OF THE INVENTION

I. Field of the Invention

The present invention relates to game boards, and more particularly to peg type score keeping game boards which are specifically suited by design to facilitate card games such as euchre.

II. Description of the Prior Art

The game of euchre was first introduced in the late 1800's and has been supplanted in popularity in the United States only by auction bridge.

In general, euchre is a card game played with thirty-two cards from a standard fifty-two card deck with all suits from duece through six inclusive eliminated. The cards rank: A (high), K, Q, J, ten, nine, eight, and seven. In the trump suit, the knave (jack) is called the "right bower" and is the highest trump. The knave of the other suit of the same color, called the "left bower" becomes the second highest trump. Thus, the trump suit always contains nine cards, the next suit (same color as the trump suit) contains seven, and each cross suit (opposite color to trump) contains eight.

Five cards are dealt to each player in rounds of three and two at a time. The next card is turned face up. Each player in turn, beginning with the eldest hand (player on the dealer's left), has the right to accept or reject the suit of the turned card as trump. If any player accepts, the dealer discards one card from his hand face down and takes the turned card instead. If all four players pass, rejecting the proposed trump, it is turned down under the pack. Thereafter, beginning with the eldest hand, each player in turn has the right to "make it" (designate another suit as trump) or to pass. If all four players pass in the second round, the hands are thrown in.

The player who makes the trump has the right to declare, "I play alone," whereupon his partner turns his cards face down and takes no part in the play, but shares in the winnings. The eldest hand makes the first lead, regardless of the position of the maker, except that if the maker plays alone the opening lead is made by the player at the maker's left.

The rules of play are as in whist. Any card may be led. Each hand must follow suit if able, but if unable may trump or discard at will. A trick is won by the highest trump, or by the highest card of the suit led. The winner of each trick leads to the next.

The object of play is to win at least three tricks. The maker's side is euchred if it fails to do so. Winning all five tricks is "march." The maker's side scores one point for winning three or four tricks, two points for march and four points for march won when playing alone. For euchre, the opponents score two points. Traditionally, the game was won by the first side to score five points, but today most players, by agreement, increase the count to ten.

There are four common variants to the game, including cut throat, two-handed, railroad and auction euchre. Cut-throat euchre is a three-handed game in which the maker always plays alone against the others in temporary partnership. The scoring is the same as in the four-handed game except that the maker scores only three points for march. Two-handed euchre is played with twenty-four cards, the normal euchre pack being reduced to eliminate sevens and eights. The twenty-four card pack also is sometimes used for the four-handed game, speeding up the play. Railroad euchre is a form of euchre in which local rules and variations are introduced. These might include the use of a joker as a tenth, and highest, trump allowing one of the opponents to oppose alone; allowing lone players to discard a bad card and replace it with the best one from his partner's unused hand; permitting any score above five points to be carried forward into the next game, etc. Finally, auction euchre is played with five, six or seven hands wherein the highest bidder makes trump and selects one or more partners, depending upon the size of his bid.

The widespread popularity of euchre as well as its characteristic rapid pace of play has caused euchre, as has poker, to become widely accepted by gamblers. Monetary wagers associated with euchre generally are established as a fixed amount for the winning player or team as well as an additional penalty levied upon the losing player or team for each euchre suffered during the course of the game. Because the playing time of individual hands in a euchre game frequently is only a matter of seconds, accurate, reliable and observable (by all players) methods of scoring are desirable, particularly when monetary wagers are at stake.

Two types of scoring games of euchre have gained wide acceptance, the use of scoring cards and pencil and paper.

The score card method of scoring euchre games is most readily appreciated by referring to FIG. 1 of the drawings. Two cards which have been excepted from the euchre deck (typically the fives of suits of like color) are selected. At the beginning of the game, one card is turned face down upon, and in register with, the second which is face up. Accordingly, none of the "spots" of the lower card will be exposed inasmuch as they are covered by the upper card. At the end of each hand, the team or player winning points will serially expose the requisite number of spots to reflect his accumulated score by sliding the upper card laterally with respect to the lower card. As illustrated in FIG. 1, the indicated score would be one point. When the player reaches a cumulative score of five points, the upper card is turned over and slid beneath the upward facing card in register therewith. When that player accumulates additional points, the process is repeated whereby the spots of the lower card are serially exposed with a total accumulation of ten, indicating the game has been won. The number of euchres suffered during the game are generally recollected only by memory at the end thereof.

The pencil-and-paper method of scoring games of euchre are essentially self-explanatory wherein the winner of points accumulates same by placing X's or otherwise marking a sheet of paper with the requisite number of points. Euchres suffered by the player are generally indicated by a distinguishing mark such as an asterisk or the like.

Although widely accepted, the score card method of scoring euchre games has a number of shortcomings. Because the score cards are typically obtained from the same original fifty-two card deck used to generate the euchre deck, they have the same appearance (pattern) on the back side thereof. Accordingly, when the euchre deck is being reassembled for shuffling between hands, all too often the score cards are inadvertently intermixed with the euchre deck, resulting in inconvenience, misdeals, and delay when the inadvertence is discovered. Additionally, because the cards are relatively light weight and the table or surface upon which the game is being played often is used to support refreshments, food and the like, the scoring cards can easily be bumped or inadvertently repositioned to indicate a false score. This problem is particularly aggravated when the game is being conducted out-of doors and wind effects the placement of the scoring cards. Reliance on memory for tabulating the number of euchres in a particular game has obvious shortcomings.

The paper-and-pencil method of scoring likewise has shortcomings in requiring the maintenance of paper and pencil which has little other utility during the course of the game and tend to get into the way. Additionally, a player must carefully and deliberately mark his score at the end of each hand to assure accuracy, a procedure which is time consuming and inconvenient to the course of the game, and is difficult to verify by the opposing player or team.

Peg-type counters have been suggested in the prior art for other card games, particularly cribbage. Although functional for use in cribbage games, cribbage boards have proven unsatisfactory in scoring euchre games. Typically, cribbage boards are relatively large and require a track of one hundred and twenty holes for each designated player plus a common "home" hole. Additionally, such boards often have arrays of peg holes indicating games won, legs, skunks, total points and the like. Finally, cribbage boards do not contemplate the use of abbreviated playing decks such as those used in euchre and thus do not provide appropriate storage facilities therein.

A large number of design variations and features of cribbage boards are evidenced in the patent literature. A typical prior art cribbage board is disclosed in U.S. Pat. No. 3,347,460 to Dickson. The Dickson patent describes a cribbage board formed from a wooden base and having several parallel paths formed by columns of one hundred twenty-one scoring holes. An overlay is received over the board whereby all but forty of the holes are covered so that a solitaire game may be played with a standard board and overlay. Finally, a peg storage area within the base of the board is disclosed.

SUMMARY OF THE INVENTION

The present invention relates to a score board for use in the game of euchre. According to the present invention, the score board comprises a body portion which defines a substantially planar playing surface which is subdivided into at least one result tabulation area, each of which include a column of N peg receiving holes for tabulating the number of points acquired by a playing entity in the course of a single game (where N equals the number of points required to win the single game) as well as a column of one-half N minus one peg receiving holes for tabulating the number of "euchres" scored by the playing entity in the course of the game. The inventive euchre score board also includes a peg associated with each of the columns which is operable for serial progression therealong during the course of the game, and at least one column of score indicating numerals which register with one of the columns of peg receiving holes. This arrangement has the advantage of providing a euchre score board which overcomes the above recited shortcomings of the prior art and provides a simplified, accurate method of keeping track of the score during the course of the game.

According to an aspect of the invention, the body portion defines an upwardly opening elongated cavity which has a major dimension of slightly greater than the height of a standard playing card and a minor dimension slightly greater than TM, where T is the thickness of a standard playing card and M is the number of cards in a euchre deck. This arrangement has the advantage of providing convenient storage of the euchre deck between hands of a continuing game.

According to another aspect of the invention, the body portion is constructed of optically clear material which overlays a base portion constructed of opaque material. Game information indicia is disposed upon the uppermost surface of the base portion. This arrangement has the advantage of presenting printed information to the players while retaining minimum overall dimensions to the score board.

According to another aspect of the invention, a column of S peg receiving holes is located within each result tabulation area for tabulating the number of games won by a playing entity in the course of a sequence of games, where S equals the number of games required to win the sequence. This arrangement has the advantage of permitting extended use of the board wherein scoring of entire game sequences can be tabulated and maintained.

According to still another aspect of the invention, one or more of the pegs include touch sensory identification means whereby a player can distinguish that peg from other pegs within the same result tabulation area by the sense of touch only. Additionally, all of the pegs within said result tabulation area define visual sensory identification means whereby a player can distinguish those pegs from an opponent's pegs in another result tabulation area by the sense of sight only. This arrangement has the advantage of permitting sure and positive identification of pegs being sequentially moved employing the senses of touch and sight.

These and other features and advantages of this invention will become apparent upon reading the following specification, which, along with the patent drawings, describes and discloses a preferred illustrative embodiment of the invention in detail.

The detailed description of the specific embodiment makes reference to the accompanying drawings.

DETAILED DESCRIPTION OF THE PREFERRED EMBODIMENT

Figure 1:
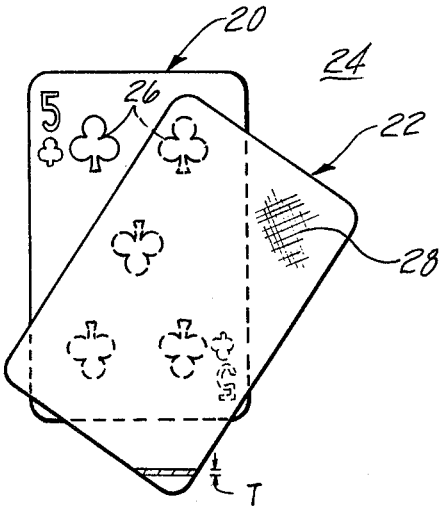
Fig-1 PRIOR ART
FIG. 1 is a plan view of a pair of standard playing cards being employed in a prior art score card method of scoring a game of euchre.

Referring to FIG. 1, two standard playing cards 20 and 22 from a fifty-two card deck are illustrated. Cards 20 and 22 are viewed from above, as if they were laying on a playing surface generally designated 24. Cards 20 and 22 are arranged for use in the score card method of scoring the game of euchre.

Card 20 is the five of clubs which is laid face up on surface 24 to expose its five "spots" 26. Card 22 is the five of spades and is oriented face down with its backside or pattern 28 facing upwardly and overlaying a portion of card 20. Each card 20 and 22 has a major dimension which, definitionally, is the vertical extent of card 20. Each card also has a characteristic thickness (T) which is illustrated in the localized cross-sectional view in the lower most corner of card 22. Card 22 is arranged to overlay a portion of card 20 and thereby obscure four of the five spots 26. This arrangement indicates a score of "one" point.

As a euchre game progresses, card 22 is repositioned laterally with respect to card 20 to sequentially expose the requisite number of spots 26 to indicate the current score of the player using cards 20 and 22. When five points have been accumulated, the player will overturn card 22 and orient it beneath card 20 (i.e. between the backside of card 20 and surface 24 with spots up and in register with card 20). When more than five points are accumulated, an additional number is indicated by again laterally repositioning card 22 in respect to card 20 to serially expose the spots of card 22 as well as those (26) of card 20. When ten points are accumulated, the combined ten spots 26 of the two cards 20 and 22 are exposed, indicating that the game has been won, presuming the players by pre-arrangement have determined that a game will constitute ten points.

Figure 2:
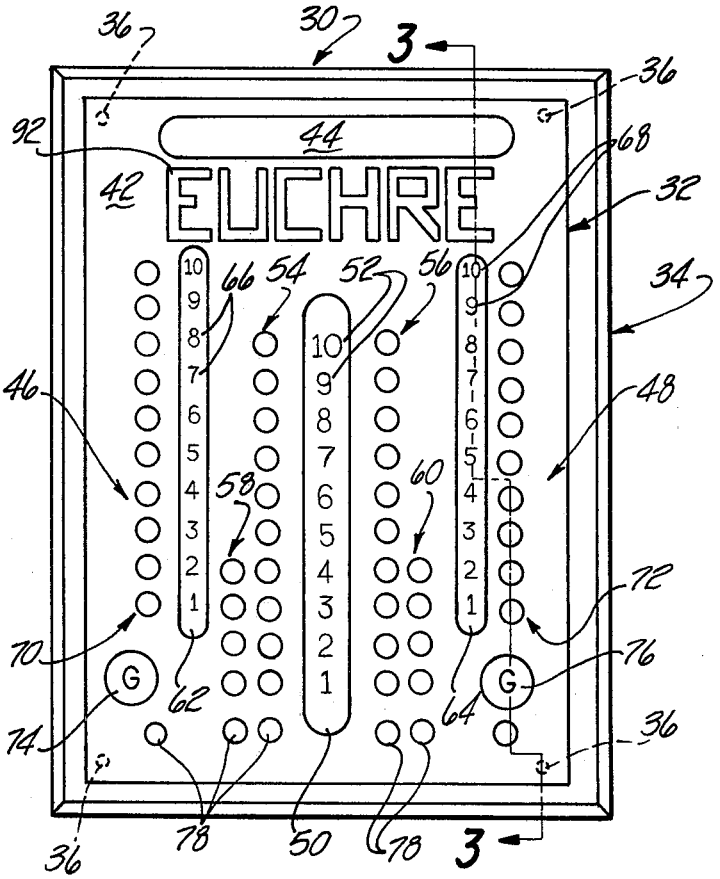
FIG. 2 is a top plan view of a euchre score board embodying the present invention.
Figure 3:
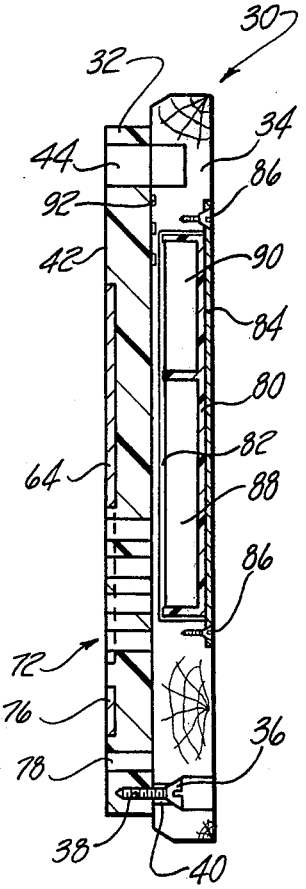
FIG. 3 is a side cross-sectional view of the euchre score board of FIG. 2.

Referring to FIGS. 2 and 3, the details of construction of a euchre score board 30 are illustrated. Score board 30 comprises a body portion 32 constructed of optically transparent material such as acrylic plastic which overlays a base portion 34 and is affixed thereto by screws 36 which pass through registering apertures 38 and 40 respectively therein. Body portion 32 defines a substantially planar playing surface 42. Base portion 34 is constructed of wood or other suitable material.

An elongated deck supporting cavity 44 is defined by portions 32 and 34, cavity 44 opening upwardly through surface 42 and having a major dimension (laterally as viewed in FIG. 2) of slightly greater than the vertical extent of card 20 as illustrated in FIG. 1. Cavity 44 has a minor dimension or width equal to TM; where T is the thickness of card 20 as illustrated in FIG. 1, and M is the number of cards in a standard euchre deck.

The score board 30 illustrated in FIGS. 2 and 3 is intended as an example only. For the sake of clarity in description, the applicant will assume a twenty-four card deck (aces through nines of the four suits) having a characteristic TM dimension of 5/16 inch. Additionally, it is assumed that the accumulation of ten points constitutes winning a game and the accumulation of ten games constitutes a winning game sequence.

Surface 42 is divided into two result tabulation areas designated 46 and 48. The line of demarcation between areas 46 and 48 comprises an elongated, vertically oriented brass insert 50 which is centered laterally on surface 42 in FIG. 2, and is affixed to body portion 32 such as by gluing. Insert 50 contains a column of score indicating numerals 52 from "one" through "ten", inclusive, which are struck within insert 50. Two columns of ten peg receiving holes 54 and 56 within tabulation areas 46 and 48 respectively straddle insert 50 and register with numerals 52. For example, the third hole up (from bottom to top in FIG. 2) of columns 54 and 56 are horizontally aligned with numeral "three" 52 in insert 50. Two columns of peg receiving holes 58 and 60 associated with tabulation areas 46 and 48 respectively are oriented substantially vertical in FIG. 2, straddling insert 50 and spaced laterally outwardly of columns 54 and 56 respectively. Columns 58 and 60 contain four peg receiving holes which register with numerals "one" through "four" inclusive 52 of insert 50.

Because a euchre is scored with two points, in a game of N points, a maximum of $\frac{1}{2}$ N euchres can be scored by a given player or playing entity (partners) in the course of winning the game. Because it would be unnecessary to indicate an additional euchre once the winning team has "pegged out", i.e., advanced their peg sequentially along column 54 or 56 until it registered with numeral "ten" in insert 50, a fifth hole for a peg tabulating the number of euchres is not required. Restated, the game terminates once one player or entity has accumulated ten points, and the pegs in columns 54 and 56 as well as columns 38 and 60 are returned to their storage positions. If a euchre is scored simultaneously with scoring the tenth point (and winning the game), the total bet is immediately reconciled, negating need for a fifth hole in columns 58 and 60. The empirical experience of the applicant's invention is that providing $\frac{1}{2}$ N−1 peg receiving holes in columns 58 and 60 maximizes efficiency in scoring a game of euchre when N points are required to win.

A pair of inserts 62 and 64 are disposed within surface 42 of body portion 32 laterally outward of insert 50 within tabulation areas 46 and 48 respectively. Inserts 62 and 64 are affixed to body portion 32 such as by gluing and contain numerals "one" through "ten" inclusive (66 and 68 respectively). Columns of S or ten peg receiving holes 60 and 72, indicative of the number of games won, are disposed in register with inserts 62 and 64 within tabulation areas 46 and 48, respectively.

Disc shaped brass inserts 74 and 76 are disposed within surface 42 of body portion 32 beneath columns 70 and 72 respectively to indicate that said columns represent the tabulation of the number of games won in a given game sequence. Inserts 74 and 76 are affixed to body portion 32 such as by gluing. Peg receiving holes 78 are provided for storing pegs employed with board 30 adjacently below each column (54, 56, 58, 60, 70 and 72). The pegs employed in the scoring process are placed in peg receiving holes 78 prior to commencing each game sequence and are removed therefrom to their respective columns only when appropriate scoring has been achieved.

Storage of a deck of playing cards and the pegs which are used with score board 30 are stored within a drawer 80 disposed within a drawer receiving cavity 82 within base portion 34. Cavity 82 is closed at the bottom by a metal plate 84 which is secured to base portion 34 such as by screws 86. Cavity 82 is defined by base portion 34 and plate 84 and opens laterally to one side of board 30. Drawer 80 is formed of injection molded plastic or the like and is divided into two compartments 88 and 90. Compartment 88 is dimensioned to receive the 24 card euchre deck and compartment 90 is dimensioned to receive six pegs. Finger gripping means (not illustrated) are provided within drawer 80 whereby the user can slide drawer 80 laterally outwardly from base portion 34 to gain access to compartments 88 and 90.

Indicia 92 such as the name of the game intended for use with score board 30 is imprinted upon the upper surface of base portion 34. It is contemplated that information such as game instructions and rules could be contained thereon and visible to the players without requiring enlargement of the overall dimensions of score board 30 or impending play in the progressive score tabulation thereon.

Figure 4:
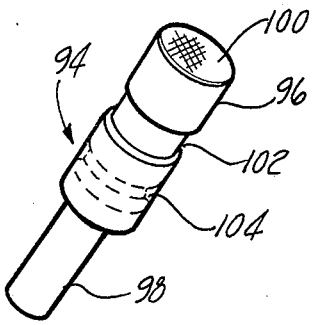
FIG. 4 is a perspective view of the peg on an enlarged scale for use with the euchre score board of FIGS. 2 and 3.

Referring to FIG. 4, a peg 94 intended for use with score board 80 is illustrated. Peg 94 is preferably constructed of optically clear material such as acrylic plastic and comprises a first end portion 96 of relatively large diameter and a second end portion 98 disposed distally from portion 96 of relatively small diameter. End portion 98 is of a diameter slightly smaller than the holes within columns 54, 56, 58, 70 and 72 as well as holes 78 to facilitate insertion therein. Portion 96 of pegs 94 project upwardly from surface 42 so as to be readily grasped and transferred between holes by the user. The upper most surface 100 of each peg 94 is provided with a visual sensory identification means such as brightly colored paint. It is contemplated that three pegs 94 associated with tabulation area 46 would be of a color distinctive from a color associated with pegs 94 of tabulation area 48. The colors of red and blue have been found to be particularly easy to distinguish.

Because each player must keep track of three separate pegs 94 having three separate score tabulating functions (number of points, number of euchres and number of games) touch sensory identification grooves 102 are provided to permit the player to readily ascertain which peg he is grasping without looking at it. A second or alternative touch sensor identification recess 104 can optionally be provided in peg 94 to allow each of the three pegs within each tabulation area 46 and 48 to be distinctive and readily identifiable from one another by the sense of touch only.

Because operation of the present invention should be readily apparent to one of ordinary skill in the art in light of the present specification, a detailed operational explanation of the use of the euchre score board 30 will be deleted here for the sake of brevity.

It is to be understood that the invention has been described with reference to a specific embodiment which provides the features and advantages previously described, and that such specific embodiment is susceptible of modification and will be apparent to those skilled in the art. Accordingly, the foregoing description is not to be construed in a limiting sense.

What is claimed is:

1. A euchre score board comprising:

a body portion defining a substantially planar playing surface subdivided into two, discrete spaced, substantially mirror image result tabulation areas, each said tabulation area comprising:

a column of only N peg receiving holes for tabulating the number of points acquired by a playing entity in the course of a single game, where N equals the number of points required to win said single game, said holes coacting to define a first uni-directional line of progression;

a column of only $\frac{1}{2}$ N−1 peg receiving holes for tabulating the number of "euchres" scored by said playing entity in the course of said game, said euchre scoring holes coacting to define a second uni-directional line of progression substantially parallel to said first line of progression;

a peg associated with each said column operable for serial progression along said associated column during the course of said game; and a column of score indicating numerals in simultaneous intermediate register with both said columns of N peg receiving holes and both said columns of $\frac{1}{2}$ N−1 peg receiving holes.

2. The euchre score board of claim 1, wherein said body portion further defines an upwardly opening elongated deck supporting cavity having a major dimension of slightly greater than the height of a standard playing card, and a minor dimension of slightly greater than TM, where T is the thickness of a standard playing card and M is the number of cards in a euchre deck.

3. The euchre score board of claim 1, further comprising a base portion constructed of opaque material underlying said body portion, said body portion being constructed of optically clear material.

4. The euchre score board of claim 3, further comprising game information indicia disposed upon the uppermost surface of said base portion.

5. The euchre score board of claim 2, further comprising compartment means operative to retain a stacked deck of M standard playing cards and said pegs.

6. The euchre score board of claim 1, further comprising a peg receiving hole associated with each said column for temporary storage of said pegs prior to the start of said game.

7. The euchre score board of claim 1, wherein each said result tabulation area further comprises a column of S peg receiving holes for tabulating the number of games won by a playing entity in the course of a sequence of games, where S equals the number of games required to win said sequence.

8. The euchre score board of claim 7, further comprising a column of game indicating numerals in register with each said column of S peg receiving holes.

9. The euchre score board of claim 1, wherein at least one of said pegs defines touch sensory identification means whereby a player can distinguish that peg from others within the same result tabulation area by the sense of touch.

10. The euchre score board of claim 9, wherein all of the pegs within said result tabulation area define visual sensory identification means whereby a player can distinguish those pegs from an opponent's pegs in another result tabulation area by the sense of sight.

11. A euchre score board comprising:

a body portion defining a substantially planar playing surface subdivided into two, discrete spaced substantially mirror image result tabulation areas, each said result tabulation area comprising:

(a) a column of only ten peg receiving holes for tabulating the number of points acquired by a playing entity in the course of a single game and substantially traversing the entire extent of said surface, said holes coacting to define a first uni-directional line of progression; and (b) a column of only four peg receiving holes for tabulating the number of "euchres" scored by said playing entity in the course of said game, said euchre scoring holes coacting to define a second uni-directional line of progression substantially parallel to said first line of progression;

a peg associated with said column operable for serial progression along said associated column during the course of said game; and a column of score indicating numerals in simultaneous intermediate register with both said columns of ten peg receiving holes and said columns of four peg receiving holes.

12. A euchre score board comprising:

a body portion constructed of optically clear material and defining a substantially planar playing surface subdivided into two discrete spaced substantially mirror image result tabulation areas, each said result tabulation area comprising:

(a) a column of only ten peg receiving holes for tabulating the number of points acquired by a playing entity in the course of a single game and substantially traversing the entire extent of said playing surface, said holes coacting to define a first uni-directional line of progression;

(b) a column of only four peg receiving holes for tabulating the number of "euchres" scored by said playing entity in the course of said game, said euchre scoring holes coacting to define a second uni-directional line of progression substantially parallel to said first line of progression;

(c) a column of only five peg receiving holes for tabulating the number of games won by said playing entity in the course of a sequence of games, where five equals the number of games required to win said game sequence, said games won scoring holes coacting to define a third uni-directional line of progression substantially parallel to said first line of progression;

(d) a column of game indicating numerals in register with said column of five peg receiving holes; and (e) column function identifying indicia associated with said column of five peg receiving holes;

said body portion further defining (i) a column of score indicating numerals on said playing surface disposed intermediate said columns of ten peg receiving holes and in simultaneous registry with said columns of ten peg receiving holes as well as said columns of four peg receiving holes, (ii) an upwardly opening elongated deck supporting cavity having a major dimension of slightly greater than the height of a standard playing card, and a minor dimension of slightly greater than 24T, where T is the thickness of a standard playing card, and (iii) a peg receiving hole associated with each said column for temporary storage of said pegs prior to the start of said game, said deck supporting cavity and said holes extending normally to said surface entirely through said body portion;

a peg associated with each said column, operable for serial progression along said associated column during the course of said game, at least one of said pegs defining touch and visual sensory identification means whereby a player can distinguish that peg from others within the same result tabulation area by the senses of touch and sight; and a base portion constructed of opaque material underlying said body portion and comprising, (i) game information indicia disposed on the uppermost surface thereof and (ii) compartment means operative to retain a stacked deck of 24 playing cards and said pegs.

* * * * *